US007150141B1

(12) United States Patent
Greenway et al.

(10) Patent No.: US 7,150,141 B1
(45) Date of Patent: Dec. 19, 2006

(54) WAIST CHAIN AND RELATED METHOD

(75) Inventors: Frank L. Greenway, Baton Rouge, LA (US); Andrew T. Roberts, Baton Rouge, LA (US)

(73) Assignee: Board of Supervisors of Louisiana State University Agricultural & Mechanical College, Baton Rouge, LA (US)

( * ) Notice: Subject to any disclaimer, the term of this patent is extended or adjusted under 35 U.S.C. 154(b) by 0 days.

(21) Appl. No.: 10/713,518

(22) Filed: Nov. 14, 2003

(51) Int. Cl.

| | |
|---|---|
| ***A44C 11/00*** | (2006.01) |
| ***A61B 5/11*** | (2006.01) |
| *B21L 1/00* | (2006.01) |
| *G01G 19/44* | (2006.01) |

(52) U.S. Cl. ..... 59/1; 2/321; 272/93; 54/23; 340/573.7; 340/555.4

(58) Field of Classification Search ..... 59/3, 59/1; 340/573.7, 555.4, 574; 54/23; 2/321, 2/325; 272/93

See application file for complete search history.

(56) References Cited

U.S. PATENT DOCUMENTS

| | | | | | |
|---|---|---|---|---|---|
| 61,777 | A | * | 2/1867 | Wallace | 59/80 |
| 1,103,760 | A | * | 7/1914 | Goodridge | 59/95 |
| 2,681,545 | A | * | 6/1954 | Hall | 59/80 |
| 4,846,462 | A | * | 7/1989 | Regnier et al. | 482/1 |
| 5,732,475 | A | * | 3/1998 | Sacks et al. | 33/555.4 |

(Continued)

FOREIGN PATENT DOCUMENTS

NZ 511508 * 4/2002

OTHER PUBLICATIONS

Garrow, John S., "Combined medical-surgical approaches to treatment of obesity," The American Journal ofClinical Nutrition 33: Feb. 1980, pp. 425-430.

(Continued)

*Primary Examiner*—David Jones
(74) *Attorney, Agent, or Firm*—Jones, Walker, Waechter, Poitevent, Carrere & Denegre, LLP

(57) ABSTRACT

Presented in one embodiment is a waist chain comprising a plurality of links; a plurality of coupling members which connect the plurality of links, thereby forming a chain with two ends; and at least one end connection member which is connectable to both ends of the chain such that the chain becomes continuous. The waist chain is positioned tightly around the waist of a person such that as the person's weight increases, the waist chain becomes increasingly tight. Presented in another embodiment is a waist chain comprising a plurality of links; a plurality of coupling members which connect the plurality of links, thereby forming a chain with two ends; at least one end connection member which is connectable to both ends of the chain such that the chain becomes continuous and at least one end link which is connectable to one or both ends of the chain and to the end connection member. The end connection member is a hollow cylinder comprising a side wall. Presented in another embodiment is a weight loss method comprising altering a person's food intake such that the person experiences weight loss; fitting the person tightly with a waist chain such that as the person's weight increases, the waist chain becomes increasingly tight. The waist chain comprises a plurality of links; a plurality of coupling members which connect the plurality of links, thereby forming a chain with two ends; at least one end connection member which is connectable to both of the ends of the chain such that the chain becomes continuous.

15 Claims, 2 Drawing Sheets

U.S. PATENT DOCUMENTS

| | | | | |
|---|---|---|---|---|
| 6,146,312 | A * | 11/2000 | Sclichter | 482/4 |
| 6,260,210 | B1 * | 7/2001 | Sjostrom et al. | 2/321 |
| 2004/0144076 | A1 * | 7/2004 | Barker | 59/1 |

OTHER PUBLICATIONS

Garrow, J.S. and Webster, Joan D., "Long-term results of treatment of severe obesity with jaw wiring and waist cord," (1986) Proceedings of the Nutrition Society, 45, 119A.

Garrow, J.S. "Morbid Obeisty: Medical or surgical treatment? The case for medical treatment," International Journal of Obesity (1987) 11, Suppl. 3, 1-4.

Garrow, J.S., "Treatment of Morbid Obesity by Nonsurgical Means: Diet, Drugs, Behavior Modification, Exercise," Gastreoenterology Clinics of North America, vol. 16, No. 3, Sep. 1987.

Garrow, J.S., "When to advise surgery for severe obesity," Postgraduate Medical Journal (1989), 65, 10-13.

Garrow, J.S., "Is it possible to prevent obesity?" Infusionstherapie 17:28-31 (Jan. 1990).

Garrow,J.S., "Treating obesity—The first law of thermodynamics still holds," BMJ, vol. 302, pp. 803-804, Apr. 6, 1991.

Garrow, J.S., "Treatment of obesity," The Lancet, vol. 340, pp. 409-413, Aug. 15, 1992.

Garrow, J.S. and Gardner, G.T., "Maintenance of weight loss in obese patients after jaw wiring," British Medical Journal, vol. 282, pp. 858-860, Mar. 14, 1981.

Garrow, J.S., "The management of obesity. Another view," International Journal of Obesity (1992) 16 (Suppl. 2), pp. S59-S63.

Gilbert, Sara and Garrow, J.S., "A prospective controlled trial of outpatient treatment for obesity," Human Nutrition: Clinical Nutrition (1983) 37C, pp. 21-29.

Simpson, G.K., Farquhar, D.L., Carr, P., Galloway, S.McL., Stewart, I.C., Donald, P., Steven, F. and Munro, J.F., "Intermittent protein-sparing fasting with abdominal belting," International Journal of Obesity (1986) 10, pp. 247-254.

* cited by examiner

WAIST CHAIN AND RELATED METHOD

I. BACKGROUND OF THE INVENTION

A. Field of the Invention

Embodiments of the present invention relate to the field of weight loss and weight maintenance. More specifically, embodiments of the present invention relate to a chain fitted around the abdomen of a person at the waist and a weight loss method utilizing the chain.

B. Description of Related Art

Clinical trials have shown that a cord snugly encircling the abdomen of a person at the waist is effective in preventing weight regain when used in conjunction with a weight loss program. Waist cords have been most effective in maintaining weight and preventing weight regain when used following a period of substantial weight loss caused by altering the person's eating habits (e.g., dieting and jaw wiring) (see Simpson, G. K. et al., Intermittent Protein-Sparing Fasting with Abdominal Belting, *International Journal of Obesity* (1986) 10, 247–254; Garrow, J. S. et al., Maintenance of weight loss in obese patients after jaw wiring, *British Medical Journal* (1981) 282, 858–860; and Garrow, J. S., The management of obesity. Another view, *International Journal of Obesity* (1992) 16 (Suppl. 2), S59–S63, all of which are incorporated herein by reference in their entireties). Such cords are ordinarily easily tightened, but not easily loosened, and provide resistance to increasing abdomen girth. As the person gains weight, resistance increases as the abdomen pushes out against the cord. Increased resistance triggers a physical response—discomfort. A tight cord helps to make the person aware of small increments of weight gain. Thus, the cord acts as an external feedback signal, alerting the person to stop eating when the cord becomes tight.

Waist cords in the art are typically constructed of nylon or plastic string, approximately 0.9 to 2.5 millimeters in diameter. These cords are ordinarily knotted at the ends, and the knots are recessed in a fastener member (e.g., a semi-hollow plastic button or rod).

There are a number of problems associated with nylon and plastic waist cords. These waist cords are too weak to perform their function, breaking during normal activities that put strain on the cord (e.g., defecation or bending). Such waist cords are difficult to clean and are susceptible to ordinary wear and tear and water exposure (e.g., during bathing). Additionally, nylon and plastic waist cords are not aesthetically pleasing and are more uncomfortable than necessary because of their inflexibility relative to the contour of the person's body.

II. BRIEF SUMMARY OF THE INVENTION

In one embodiment, the present invention provides a waist chain comprising a plurality of links; a plurality of coupling members which connect the links, thereby forming a chain with two ends; and an end connection member which is connectable to both ends of the chain such that the chain becomes continuous. In this embodiment, the chain is positioned tightly around the waist of a person such that as the person's weight increases, the waist chain becomes increasingly tight.

In another embodiment, the present invention provides a plurality of links; a plurality of coupling members which connect the links, thereby forming a chain with two ends; an end connection member which is connectable to both ends of the chain such that the chain becomes continuous; and at least one end link which is connectable to one or both ends of the chain and to the end connection member. In this embodiment, the end connection member is a hollow cylinder comprising a sidewall.

In another embodiment, the present invention provides a weight loss method comprising altering a person's food intake so that the person experiences substantial weight loss and fitting the person tightly with a waist chain such that as the person's weight increases, the waist chain becomes increasingly tight.

III. BRIEF DESCRIPTION OF THE SEVERAL VIEWS OF THE DRAWINGS

IV. DETAILED DESCRIPTION OF THE INVENTION

Figure 1:
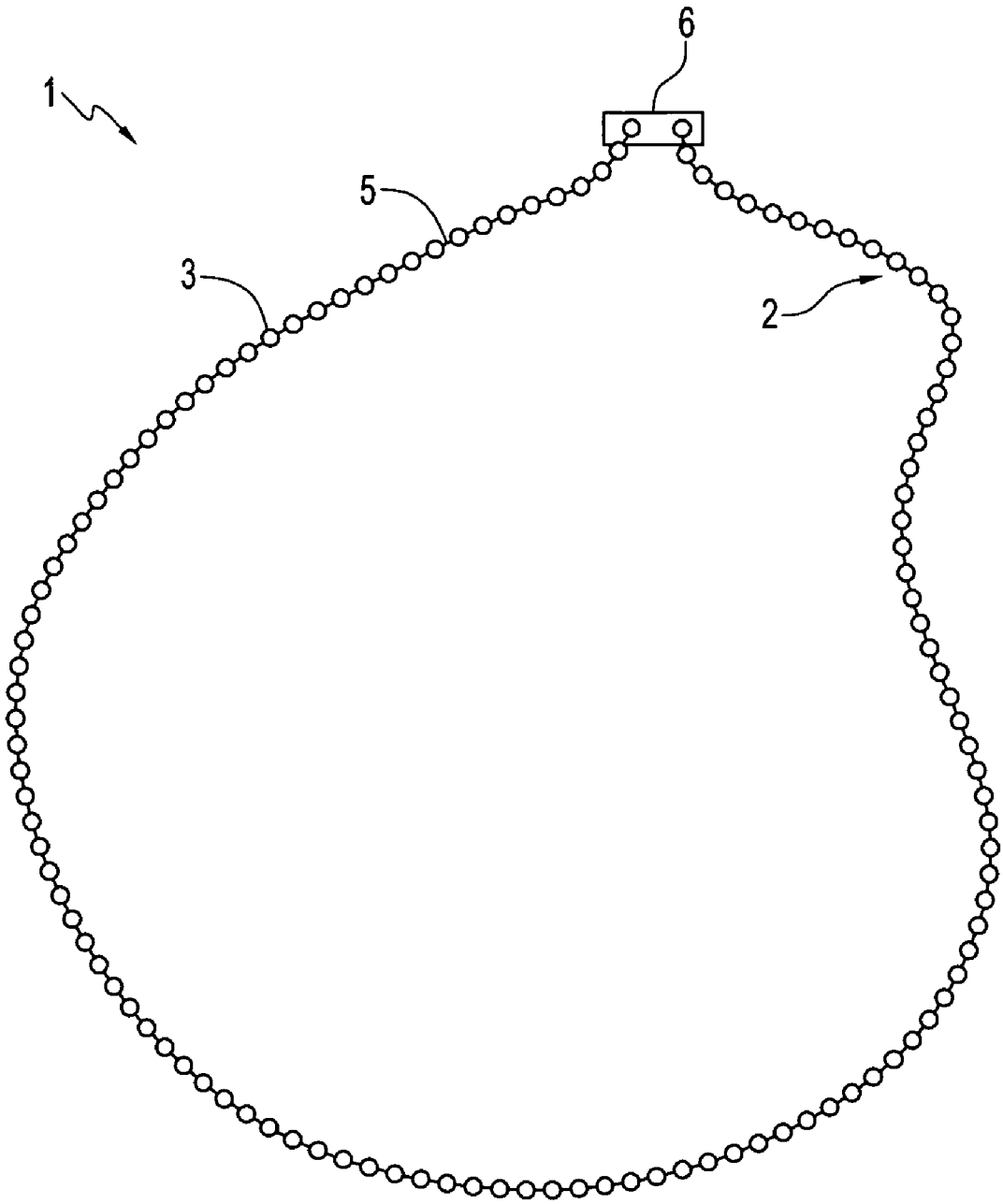
FIG. 1 is a view of the waist cord of the present invention.

The invention comprises a waist chain 1 made up of a chain 2 of links 3. Links 3 are connected to each other by coupling members 5. In one embodiment (shown in FIGS. 1–3), links 3 are small and spherical. However, links 3 may be shaped differently. Links 3 may be any shape or size which allows the chain to be positioned tightly around the waist of a person and allows links 3 to rotate, thereby allowing the waist chain 1 to be adjusted relative to the contour of the person's body. For example, links 3 could be generally cylindrical. Further, all of the links 3 in the chain 2 need not be the same shape or size.

In one embodiment (shown in FIG. 3), each link 3 has two circular openings 9 which communicate with the hollow interior 11 of link 3. Openings 9 are located at opposite ends of a center axis of link 3. One end 10 of each coupling member 5 extends into one opening 9 in link 3, and the opposite end (not pictured) of coupling member 5 extends into one opening in an adjacent link 3. Ends 10 of coupling members 5 are larger than openings 9 in link 3. This method of connection allows each link 3 to rotate around the axis extending through openings 9 and also allows each link 3 to move along coupling member 5 toward the middle of coupling member 5. This allows waist chain 1 to move (or be adjusted by the person) relative to the contour of the person's body, thereby making waist chain 1 more comfortable to wear than nylon or plastic waist cords. In one embodiment, coupling members 5 are rod-shaped and ends 10 are T-shaped (as clearly shown in FIG. 3). Obviously, coupling members 5 and ends 10 may be shaped differently; for example, coupling members 5 could have a curved shape, and ends could take the form of small spheres, provided that such alternate shapes allow the waist chain to function as described above.

Figure 2:
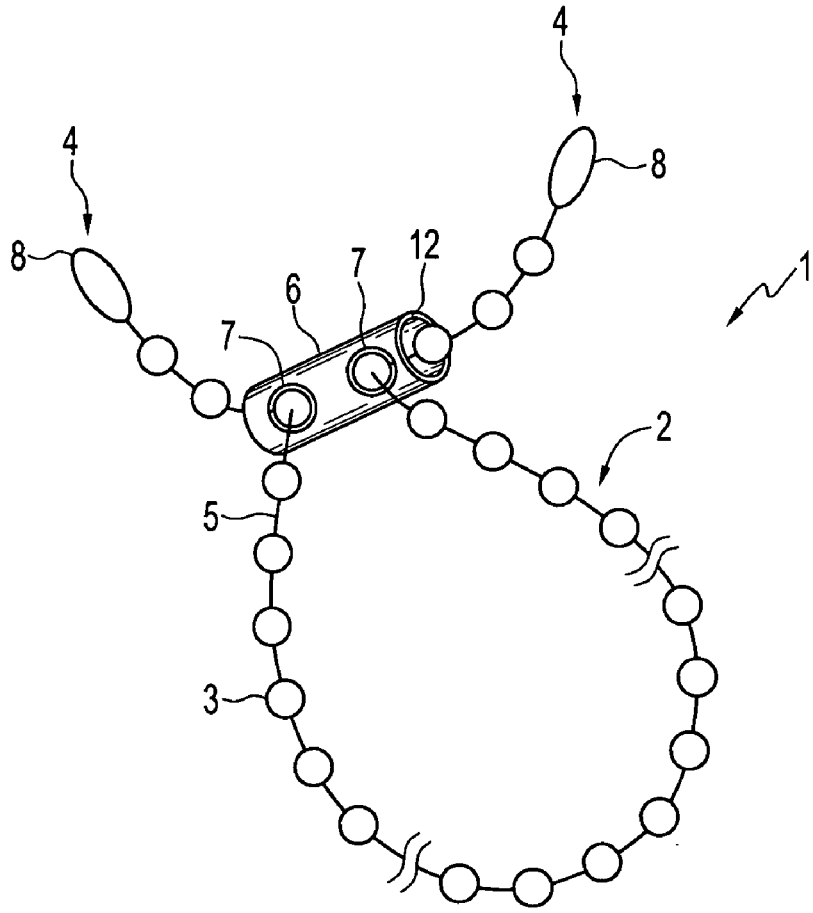
FIG. 2 is an alternate view of the waist cord of the present invention.
Figure 3:
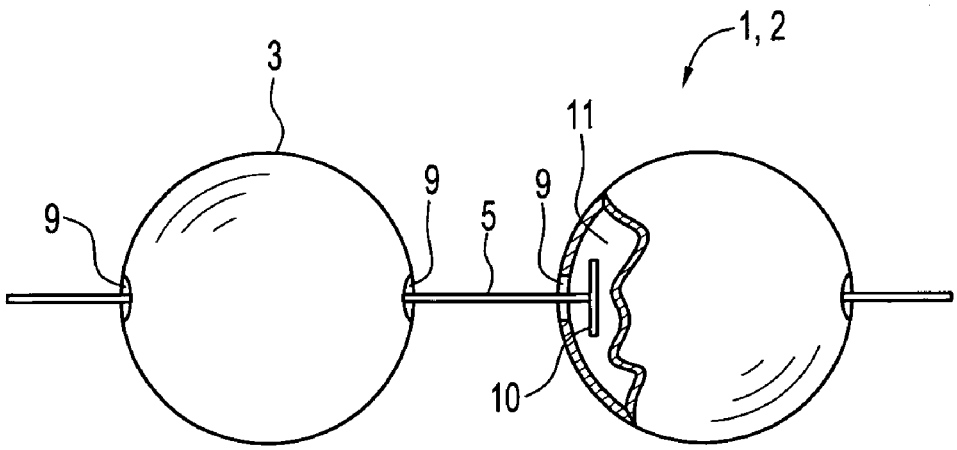
FIG. 3 is an enlarged view of part of the waist cord of the present invention showing a cut-away view of one of the links.

In the embodiment shown in the figures, chain 2 has two ends 4. Ends 4 are connected by an end connection member 6. End connection member 6 is connectable to both ends 4 of chain 2. In this embodiment, end connection member 6 is a relatively short, hollow cylinder (as seen in FIG. 2). End connection member 6 further comprises two openings 7 in sidewall 12 through which ends 4 of chain 2 are threaded. Openings 7 are located toward each end of end connection member 6. End links 8 are connected to ends 4 of chain 2. In this embodiment, the size of each end link 8 is larger than the corresponding opening 7 such that end link 8 prevents end 4 of chain 2 from passing back through opening 7 in end connection member 6. Thus, when ends 4 of chain 2 are threaded through openings 7 in end connection member 6, waist chain 1 becomes continuous. In this embodiment, the length of waist chain 1 can be decreased (by pulling one or both ends 4 of chain 2 further through openings 7 in the end connection member 6 and connecting end link 8 to a different link 3), but the length of waist chain 1 cannot be made longer than the initial maximum length because end links 8 prevent ends 4 of chain 2 from passing out of openings 7 in end connection member 6.

End link 8 may attach to a link 3, or to a coupling member 5. End link 8 may be removably attachable to chain 2 such that once chain 2 is shortened, the remaining non-continuous portion of chain 2 could be cut, thereby defining a new, shortened maximum length. End link 8 may also be permanently attached to chain 2 at a desired point, such as by soldering, crimping or by the application of glue or other adhesive. In this embodiment, the excess portion of chain 2 is simply cut off when shortening is desirable, and a new end link 8 is permanently attached at the new end 4 of chain 2. This may prove to be desirable to prevent tampering by a person, whereby any reduction in the length of waist chain 1 is performed by a health care professional in association with a patient consultation. Obviously, both ends 4 of chain 2 need not be removably connectable with end connection member 6. One end 4 of chain 2 may be permanently connectable to end connection member 6 (without the need for an end link 8) and the other end 4 of chain 2 may function as described above to allow the length of waist chain 1 to be shortened, but not lengthened. Further, end link 8 may simply comprise the last link 3 at the end 4 of chain 2, in which case end connection member 6 would be fixedly attachable to end link 8.

End link 8 may be shaped in a number of ways. For example, end link could take the form of a clip, latch, or other configuration which allows end 4 of chain 2 to be connectable with end connection member 6. By the same token, end connection member 6 may be shaped in a number of ways to be connectable with such different forms of end link 8. For example, end connection member may be shaped in such a way to mate with a clip or latch end link 8.

In one embodiment, waist chain 1 is constructed of metal. Metal can provide greater strength than nylon or plastic. The metal waist chain 1 is better able to withstand strain caused by everyday physical activity such as defecation or bending over, but the chain is not so strong that it cannot be cut if necessary. Further, the metal linked waist chain 1 is aesthetically pleasing, resembling a piece of jewelry. In one embodiment, waist chain 1 is constructed of stainless steel, which is durable, hypoallergenic, and easy to keep clean.

In one embodiment, the present invention comprises a method for using the waist chain 1 described above. First, the person's eating habits are altered to produce substantial weight loss. This could be accomplished in a number of ways, including without limitation having the person's jaw wired and placing the person on a controlled liquid diet, modifying and monitoring the person's diet in an inpatient or outpatient dieting program, exercise, and weight loss medications. Next, the person is fitted with a waist chain 1 such as the metal waist chain described above. Waist chain 1 is placed around the person's waist. Ends 4 of chain 2 are pulled through openings 7 in end connection member 6 and waist chain 1 is fitted for length. Initially, waist chain 1 should be fitted tightly, but not uncomfortably. As used herein, "tightly" means that the waist chain is applied with a tightness that leaves no indentation of the skin when the person is supine but produces a white (not red) line on the skin when the person is seated. As the person's weight increases, the waist chain becomes increasingly tight, thereby making the person aware of relatively small increments of weight gain. Although each person will be slightly different, waist chain 1 is fitted properly when it becomes uncomfortable if the person gains approximately 5.6±2.1 kg (standard deviation). When the desired length of waist chain 1 is determined, chain 2 should be cut accordingly. End links 8 are then placed at both ends 4 of chain 2 and pulled into end connection member 6.

The person's weight is monitored while the person is fitted with waist chain 1. Because it is tightly fit to the person's waist, increases in the person's weight make waist chain 1 uncomfortable to wear. This discomfort is a constant reminder to the person to continue to monitor the person's diet to maintain or continue to lose weight. If the person continues to lose weight, waist chain 1 may be shortened accordingly. The linked design allows the length of the waist chain 1 to be adjusted by small, uniform lengths. Links 3 removed from waist chain 1 could be fashioned into a decorative jewelry item for the person as an encouraging part of the weight maintenance or weight loss or program.

Other embodiments of the invention will occur to those skilled in the art and are intended to be included within the scope and spirit of the following claims.

What is claimed is:

1. A weight loss method comprising: fitting a person tightly with a waist chain such that as said person's weight increases, said waist chain becomes increasingly tight, wherein said waist chain comprises:

a. plurality of links;

b. a plurality of coupling members which connect said plurality of links, thereby forming a chain, said chain comprising two ends;

c. at least one end connection member which is connectable to both of said ends of said chain such that said chain becomes continuous; and d. said plurality of coupling members are rotatably connected to said plurality of links.

2. The weight loss method of claim 1, wherein said waist chain further comprises at least one end link, said end link being connectable to one or both ends of said chain and to said end connection member.

3. The weight loss method of claim 2, wherein said end connection member is a hollow cylinder comprising a sidewall.

4. The weight loss method of claim 3, wherein said end connection member further comprises at least one opening in said sidewall, wherein at least one of said ends of said chain extends through one said opening in said end connection member and said at least one end link prevents said end of said chain from passing out of said opening in said end connection member.

5. The weight loss method of claim 4, wherein said end link is permanently connectable to at least one of said ends of said chain.

6. The weight loss method of claim 4, wherein said end link is removably connectable to at least one of said ends of said chain.

7. The weight loss method of claim 4, wherein said links, said coupling members, said end link, and said end connection member are constructed of metal.

8. The weight loss method of claim 7, wherein said metal is stainless steel.

9. The weight loss method of claim 2, wherein said plurality of links are spherical.

10. The weight loss method of claim 2, wherein said plurality of links are hollow.

11. The weight loss method of claim 2, wherein said plurality of links are slidably connected to said plurality of coupling members.

12. The weight loss method of claim 2, wherein said plurality of coupling members are rotatably connected to said plurality of links.

13. The weight loss method of claim 2, wherein said plurality of coupling members are rod-shaped.

14. The weight loss method of claim 2, wherein said end connection member is permanently connectable to at least one of said ends of said chain.

15. The weight loss method of claim 2, wherein said end connection member is removably connectable to at least one of said ends of said chain.

* * * * *